US008826800B2

(12) United States Patent
Inden

(10) Patent No.: US 8,826,800 B2
(45) Date of Patent: Sep. 9, 2014

(54) RECIPROCATING PISTON MECHANISM WITH EXTENDED PISTON OFFSET

(76) Inventor: Michael Inden, Belmont, CA (US)

( * ) Notice: Subject to any disclaimer, the term of this patent is extended or adjusted under 35 U.S.C. 154(b) by 761 days.

(21) Appl. No.: 12/932,053

(22) Filed: Feb. 17, 2011

(65) Prior Publication Data

US 2012/0210866 A1 Aug. 23, 2012

(51) Int. Cl.

| | |
|---|---|
| ***F01B 7/04*** | (2006.01) |
| ***F01B 9/00*** | (2006.01) |
| ***F04B 53/00*** | (2006.01) |
| ***F04B 35/01*** | (2006.01) |
| ***F04B 39/00*** | (2006.01) |
| ***F02F 7/00*** | (2006.01) |
| ***F01B 9/02*** | (2006.01) |
| ***F04B 9/04*** | (2006.01) |

(52) U.S. Cl.

CPC ..... *F02F 7/0019* (2013.01); *F04B 53/006* (2013.01); *F04B 35/01* (2013.01); *F04B 39/0094* (2013.01); *F01B 9/02* (2013.01); *F04B 9/045* (2013.01)

USPC ..... 92/68; 92/140

(58) Field of Classification Search

USPC ..... 74/48, 49; 92/68; 123/197.4

See application file for complete search history.

(56) References Cited

U.S. PATENT DOCUMENTS

| | | | | |
|---|---|---|---|---|
| 810,347 | A | 1/1906 | Porter et al. | |
| 2,123,306 | A * | 7/1938 | Hood | 74/570.1 |
| 2,957,455 | A | 10/1960 | Bouvy | |
| 2,974,541 | A | 3/1961 | Dolza | |
| 4,628,876 | A | 12/1986 | Fujikawa et al. | |
| 4,708,096 | A | 11/1987 | Mroz | |
| 4,803,964 | A * | 2/1989 | Kurek et al. | 123/197.4 |
| 4,945,866 | A | 8/1990 | Chabot, Jr. et al. | |
| 4,974,554 | A | 12/1990 | Emery | |
| 5,076,220 | A | 12/1991 | Evans et al. | |
| 5,146,884 | A | 9/1992 | Merkel | |
| 5,186,127 | A | 2/1993 | Cuatico | |
| 5,544,627 | A | 8/1996 | Terziev et al. | |
| 5,749,262 | A | 5/1998 | Galvin | |
| 5,816,201 | A | 10/1998 | Garvin | |
| 6,009,845 | A * | 1/2000 | Ehrlich | 123/197.4 |
| 6,058,901 | A | 5/2000 | Lee | |
| 6,202,622 | B1 | 3/2001 | Raquiza, Jr. | |
| 6,234,138 | B1 * | 5/2001 | Cathey | 123/197.4 |

(Continued)

FOREIGN PATENT DOCUMENTS

| | | |
|---|---|---|
| DE | 2855667 | 7/1980 |
| DE | 3410548 | 9/1985 |

(Continued)

*Primary Examiner* — Edward Look
*Assistant Examiner* — Daniel Collins

(57) ABSTRACT

The reciprocating piston mechanism with an extended piston offset is provided. The mechanism is of the type that contains at least one cylinder having a longitudinal axis, at least one piston that has a pivot pin and is slidingly installed in the cylinder, a main driveshaft having a central axis, which is offset at a distance from the longitudinal axis of the cylinder, a circular cylindrical body, e.g., a circular eccentric, which is non-rotationally secured on the main drive shaft and a rocker arm. The rocker arm is pivotally mounted on the circular eccentric. The mechanism is also provided with a connecting rod that connects the cylinder to one arm of the rocker arm/lever. The other arm of the rocker arm/lever has a roller that is guided in a confined pathway and works as a fulcrum of the lever and a stabilizer/rudder at the same time.

9 Claims, 7 Drawing Sheets

(56) References Cited

U.S. PATENT DOCUMENTS

| | | | | |
|---|---|---|---|---|
| 6,460,505 | B1 | 10/2002 | Quaglino, Jr. | |
| 6,904,888 | B1 * | 6/2005 | Heifets | 123/197.1 |
| 8,171,889 | B2 * | 5/2012 | Lindfors et al. | 119/712 |
| 2011/0146601 | A1 * | 6/2011 | Fisher | 123/62 |

FOREIGN PATENT DOCUMENTS

| | | |
|---|---|---|
| FR | 2593232 | 7/1987 |
| GB | 1133618 | 6/1965 |
| GB | 2219345 | 12/1989 |
| JP | 60-256642 | 12/1985 |

* cited by examiner

RECIPROCATING PISTON MECHANISM WITH EXTENDED PISTON OFFSET

TECHNICAL FIELD

The present invention relates to a reciprocating piston mechanism such as an internal combustion engine, compressor, pump or the likes. More specifically, the present invention relates to modular sub-assemblies for an internal combustion engine, compressor, pump or the likes which include a driveshaft, a circular eccentric mounted on the driveshaft and a piston with an offset between the piston cylinder center line and the driveshaft axis. This altered geometrical relationship provides increased power and torque for an internal combustion engine.

BACKGROUND OF THE INVENTION

Internal combustion engines are any of a group of devices in which the reactant of combustion, e.g., oxidizer and fuel, and the products of combustion serve as the working fluids of the engine. Internal combustion (IC) engines can be categorized into spark ignition (SI) and compression ignition (CI) categories. SI engines, i.e. typical gasoline engines, use a spark to ignite the air-fuel mixture, while the heat of compression ignites the air-fuel mixture in CI engines, i.e., typically diesel engines. The basic concept of the design of both a typical gasoline engine and a diesel engine has not changed for more than 100 years.

The basic components of an internal combustion engine are well known in the art and include the engine block, cylinders, pistons, valve, crankshaft and camshaft. Such an engine gains its energy from the heat released during the combustion of the non-reacted working fluids, e.g., the oxidizer-fuel mixture. In all internal combustion engines, useful work is generated from the hot, gaseous products of combustion acting directly on moving surfaces of the engine, such as the top or crown of a piston.

One of the primary and consistent design goals for internal combustion engines is to increase power and torque. Until very recently, simple upward scaling of the size and/or capacity of the engine and associated components was a feasible way, and perhaps the easiest way, to achieve this goal. That is, horsepower and torque could be increased simply by increasing piston displacement, air flow capacity, etc. Piston displacement is directly dependant on the size of a crankshaft. The earliest evidence of a crank-connecting rod system as a part of a machine is traced back to $3^{rd}$ century AD. The crankshaft contains two or more centrally located coaxial cylindrical or "main" journals and one or more offset cylindrical crankpin or "rod" journals. The crankshaft main journals rotate in a set of supporting main bearings, causing the offset rod journals or "throw" to rotate in a circular path around the main journal centers, the diameter of which is twice the offset of the rod journals. In the engine having a piston reciprocally disposed in a cylinder extending through the engine cylinder block, the piston is normally connected to a rotating crankshaft by means of a connecting rod. One end of this connecting rod is connected to a wrist pin disposed inside of the piston and accordingly, reciprocates along a straight line. The other end of the rod is journaled on the throw projecting from the crankshaft and accordingly, travels in the circular path. The diameter of that circular path is equal to the distance the piston moves up and down or "piston displacement" in its cylinder, which is called a "stroke". In a typical arrangement of an internal combustion engine a piston cylinder centerline intersects the longitudinal axis of the crankshaft. If the crankshaft is configured appropriately, the engine may benefit through increased torque placed on the crankshaft as well as a reduction in friction forces between the piston and the piston cylinder.

Referring to FIG. 1, an alternative to the above-described conventional crankshaft is a crankshaft-free driveshaft and piston assembly. This apparatus is disclosed generally in pending U.S. patent application Ser. No. 12/151,954 to Michael Inden, filed on May 12, 2008, titled Crankshaft-Free Drive Shaft and Piston Assembly of a Split-Cycle Four-Stroke Engine, which is herein incorporated by reference in its entirety. The apparatus 20 (for simplicity of the drawing and description the cylinder block of an engine and other engine components are not shown) is a driveshaft and piston assembly that comprises a rotary driveshaft 22 (hereinafter referred to merely as "a shaft") of a square cross-section which includes a circular eccentric 24 mounted in its indexed position and a pair of integrally mounted cylindrical bushings 26*a* and 26*b*. The shaft 22 is journaled at the bushings 26*a* and 26*b* for rotation about a shaft axis 28. A connecting rod 30 is pivotally connected to both the circular eccentric 24 of the shaft 22 and a piston 32 at its top distal end. The mechanical linkage of the connecting rod 30 to the piston 32 and the circular eccentric 24 which is indexed on the shaft 22 serves to convert the reciprocating motion of the piston (as indicated by directional arrow A for the piston 32) to the rotational motion (as indicated by directional arrow B) of the shaft 22. The cylindrical bushings 26*a* and 26*b* have a coaxial opening of substantially the same cross-section as a cross-section of the shaft 22 of FIG. 1.

Though this embodiment of the invention shows cross-sections of the shaft 22 and the opening of the circular eccentric 24 as substantially square, it is within the scope of this invention that other cross-sections may also be employed, such as other polygons with different numbers of sides, ellipses, or others which will assure an indexed position of the circular eccentric 24 on the shaft 22.

FIGS. 2 and 3, which are schematic diagrams of an exemplary embodiment of two circular eccentrics 36 and 38, illustrate how orientation of openings 40 and 42 for mounting circular eccentrics on a shaft provides indexing of the circular eccentrics on the shaft. FIG. 2 illustrates the circular eccentric 36 which has an opening 40 of substantially the same cross-section as a cross-section of the shaft 22, positioned at a distance E from the center of the circular disk 36. The opening 42, of the substantially same cross-section positioned at the same distance E from the center of the circular disk 38 in FIG. 3, is turned at an angle G, with respect to the position of the opening 40 of the circular eccentric 36 of FIG. 2. Because in a four-stroke cycle engine, a four stroke cycle is completed in two revolutions of a shaft, the second index angle is equal to 720 degrees divided by the number of pistons in an engine and so on. Because in a two-stroke cycle diesel engine, a stroke cycle is completed during one revolution of a shaft, the second indexed angle is equal to 360 degrees divided by the number of pistons in an engine.

Many attempts have been made over the years to increase the efficiency of the conventional engine design. Because the internal combustion engine works partially off of the torque created by the rotation of the crankshaft, it is important that the engine creates as much torque with as little effort in order to be more efficient and use less fuel in the process. One such attempt involves laterally offsetting the axis of rotation of the crankshaft from the axis of the piston cylinder.

With different reasoning, but with the same goal to improve torque and power of the engine, several technologies relating to reciprocating piston mechanism in which the crankshaft axis is offset from the piston cylinder axes have been proposed in U.S. Pat. Nos. 810,347; 2,957,455; 2,974,542; 4,628,876; 4,708,096; 4,945,866; 4,974,554; 5,070,220; 5,146,884; 5,186,127; 5,544,627; 5,749,262; 5,816,201; 6,058,901; 6,202,622 and 6,460,505; in Germany patent documents 2,855,667 and 3,410,548; Great Britain patent documents 1,133,618 and 2,219,345; in France patent document 2,593,232; Japan patent document 60-256,642. One such attempt involves controlling timing of combustion within the cylinder to cause maximum combustion pressure within the cylinder during a power stroke to occur when the piston cylinder centerline coincides with the respective throw connection axis of the crankshaft. Typically, the offset in this kind of configuration is less than a half of the throw of the crankshaft. In another attempt, the offset crankshaft is located such that at a point during the power stroke the crankshaft throw is perpendicular to the vertical axis of the piston cylinder and the connecting rod is substantially collinear with the vertical axis of the piston cylinder. This configuration leads to a long connecting rod. In yet another attempt, in order to maximize the offset of the cylinder, a curved, bowed-shaped or offset connecting piston rod is added with the intention to increase the engine torque and overall power. Force, moving the piston down the cylinder is transmitted to the crankshaft in the direction from the wrist pin disposed inside of the piston to the offset rod journal of the crankshaft. The other component of the piston force is responsible for friction loses between the piston and the cylinder. In these particular configurations with the offset connecting rod, increase in the crankshaft rotating force is negated by significantly increased friction loses between the piston and the cylinder.

Thus, none of the above mentioned approaches which involves laterally offsetting of the axis of rotation of the crankshaft from the axis of the piston cylinder, allows any significant improvement of the torque created by the rotation of the crankshaft and consequently engine power and efficiency without significant enlargement of the crankshaft.

Output power of an engine is defined as a product of torque, speed of rotation of a shaft and units' conversion coefficient. The magnitude of the torque depends on a force applied and a moment arm, which is a distance from the axis of rotation to the direction of the force application. In cases involving an internal combustion engine with a crankshaft, the offset rod journal, or throw of the crankshaft, rotates in a circular path around the main journal center and moves the bottom distal end of the connecting rod from one side of the centerline of the cylinder to another. Thus, during a power stroke when combustion is taking place in the combustion chamber of the cylinder, the length of the moment arm fluctuates from 0 to the length of the crankshaft throw and back to 0. All of this leaves little room for an engineer to influence the output power.

Accordingly, there is still a need to increase the torque generated during a power stroke of an internal combustion engine, and thus, increase power output of the engine or decrease fuel consumption for desired power output of the engine and increase engine efficiency and the present invention resolves this need by providing a mechanism to increase the force applied to the driveshaft moment arm.

SUMMARY OF THE INVENTION

It is an object of this invention to provide a reciprocating piston mechanism to increase force applied to the driveshaft moment arm.

It is another object of this invention to provide a reciprocating piston mechanism which will reduce relationship between a piston stroke and the length of the driveshaft/crankshaft moment arm.

It is yet another object of the invention to provide a reciprocating piston mechanism with an increased torque on the driveshaft of the engine.

It is another object of this invention to provide a reciprocating piston mechanism for an internal combustion engine which increases fuel efficiency for the required engine power output.

It is yet another object of the invention to provide a reciprocating piston mechanism for an internal combustion engine which is simple in design and inexpensive to manufacture. The reciprocating piston mechanism of the present invention, e.g., for an internal combustion engine with extended piston offset, is of the type that contains at least one cylinder having a longitudinal axis, at least one piston that has a pivot pin and is slidingly installed in the cylinder, a main driveshaft having a central axis, which is offset at a distance from the longitudinal axis of the cylinder, a circular cylindrical body, e.g., a circular eccentric, which is non-rotationally secured on the main drive shaft, a rocker arm, which in essence is a second order lever, pivotally mounted on the said circular eccentric and a connecting rod connecting the cylinder and one arm of the rocker arm/lever. The other arm of the rocker arm/lever can move back and forth only along a substantially defined line in a confined pathway or a guide and works as a stabilizer/rudder. In other words, a distinguishing feature of the reciprocating piston mechanism of the invention with extended piston offset is the rocker arm/lever that has a substantially circular opening which pivotally receives the circular eccentric and a fulcrum which moves along a substantially defined line in the guide during rotation of the driveshaft. The distance from the central axis of the main driveshaft and the longitudinal axis of the cylinder is always greater than 0. Such a construction significantly improves torque applied to the driveshaft and efficiency of the engine.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF THE PREFERRED EMBODIMENTS

Figure 1:
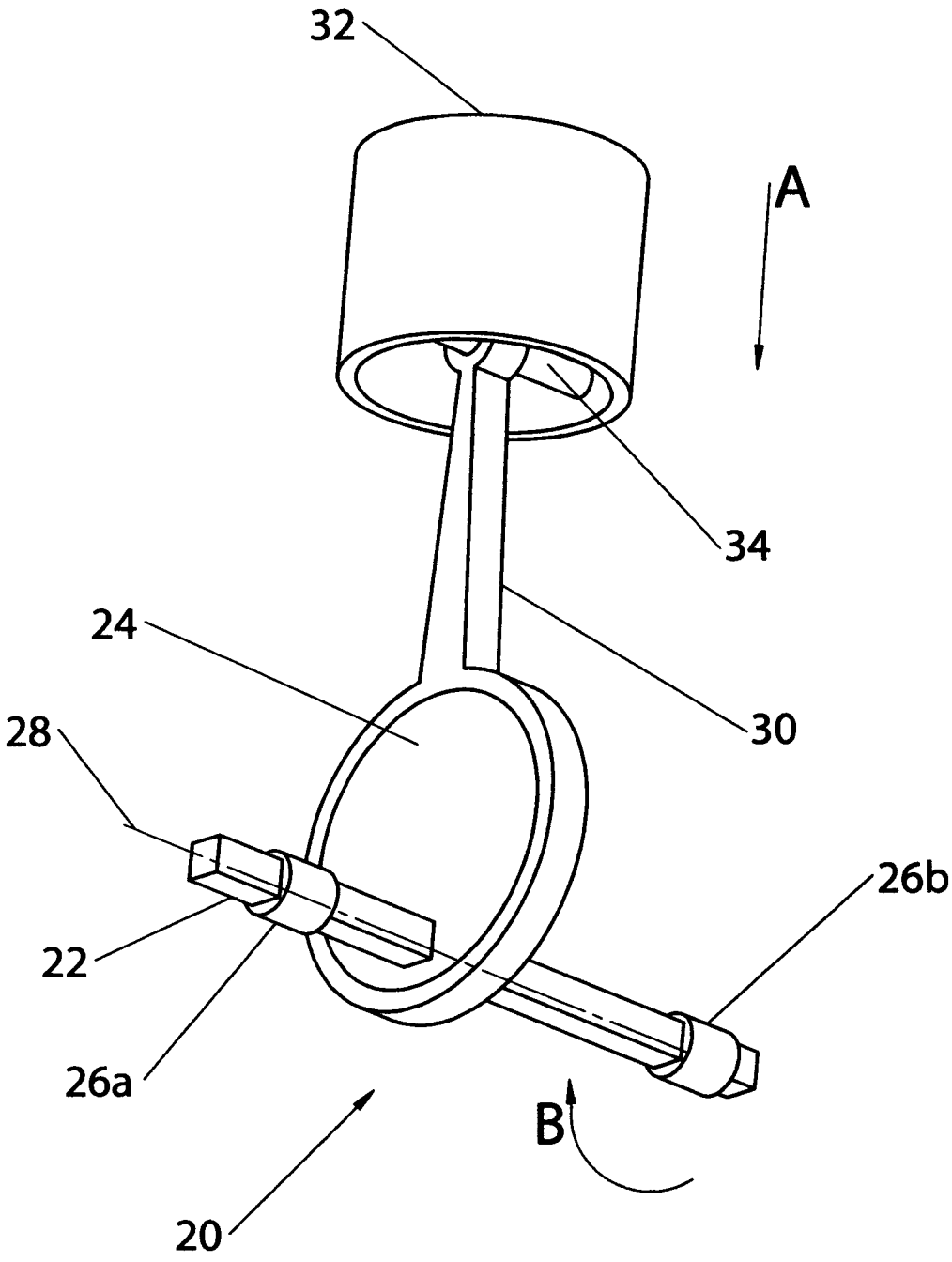
FIG. 1 PRIOR ART
FIG. 1 is a schematic diagram of an exemplary embodiment of the apparatus of the prior art crankshaft-free driveshaft and piston assembly of an internal combustion engine.
Figure 2:
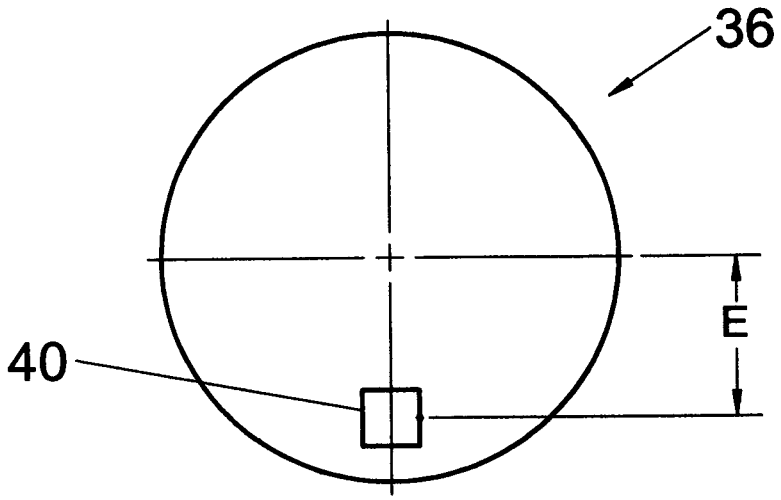
FIG. 2 PRIOR ART
FIG. 2 is a schematic diagram of a prior art cylindrical eccentric in the first indexed position of an internal combustion engine.
Figure 3:
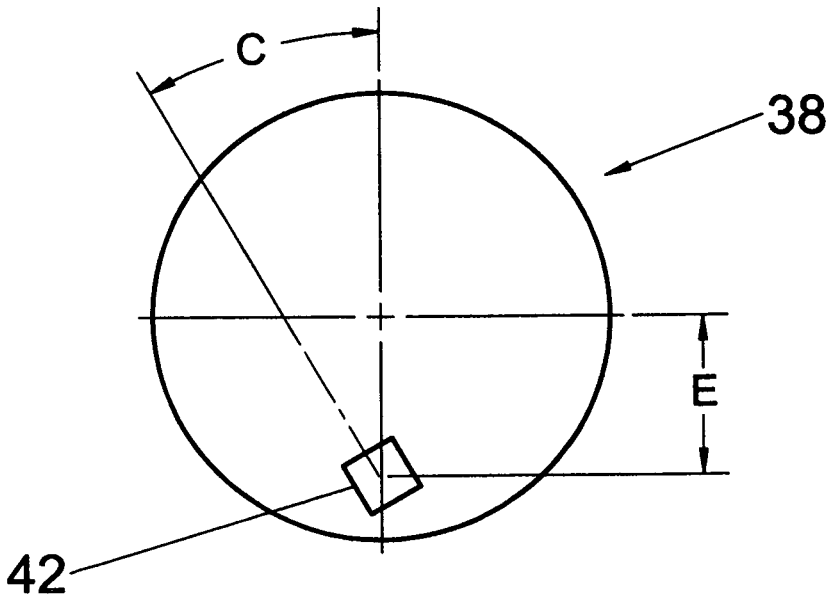
FIG. 3 PRIOR ART
FIG. 3 is a schematic diagram of a prior art cylindrical eccentric in the second indexed position of an internal combustion engine.
Figure 4:
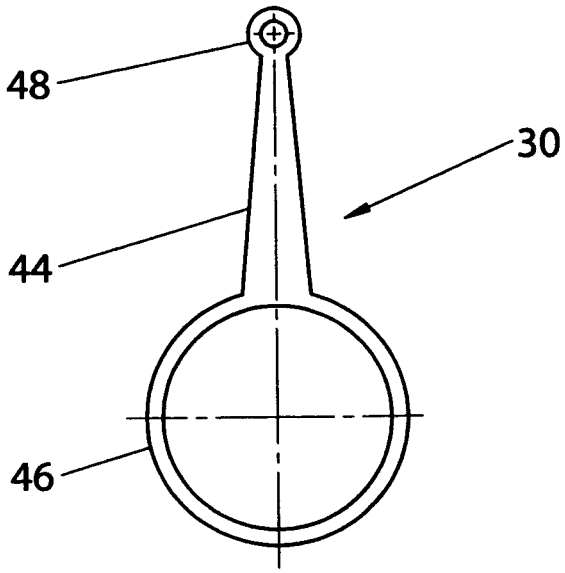
FIG. 4 PRIOR ART
FIG. 4 is a schematic diagram of an exemplary embodiment of a connecting rod of the prior art crankshaft-free driveshaft and piston assembly of a split-cycle four-stroke.

The basic components of a reciprocating piston mechanism are well known in the art and include at least one cylinder, one piston, a connecting rod and a crankshaft. For better understanding the distinguishing features of the present invention, it would be appropriate to again refer to the structure of a connecting rod used in an internal combustion engine which was disclosed in U.S. patent application Ser. No. 12/151,954 filed earlier by the same applicant and the improvement of which the present application is aimed. More specifically, FIG. 4 illustrates an exemplary embodiment of a connecting rod 30 of a crankshaft-free driveshaft and piston assembly of a split-cycle four-stroke engine. The connecting rod 30 comprises a straight arm 44 connecting a small distal end 48 for attachment to a piston pin (not shown in FIG. 4) and a big end 46 for pivotally connecting to a circular eccentric (not shown in FIG. 4). In a mechanism with this type of a connecting rod, piston stroke and engine torque are defined only by features of a circular eccentric, such as eccentric diameter and eccentricity.

Figure 5:
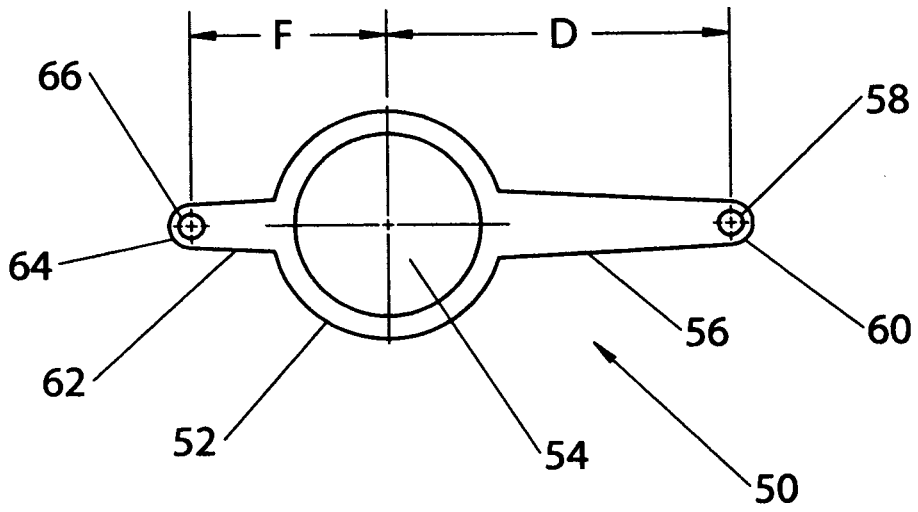
FIG. 5 is a schematic diagram of an exemplary embodiment of a rocker arm/lever for an inline engine of the present invention.
Figure 6:
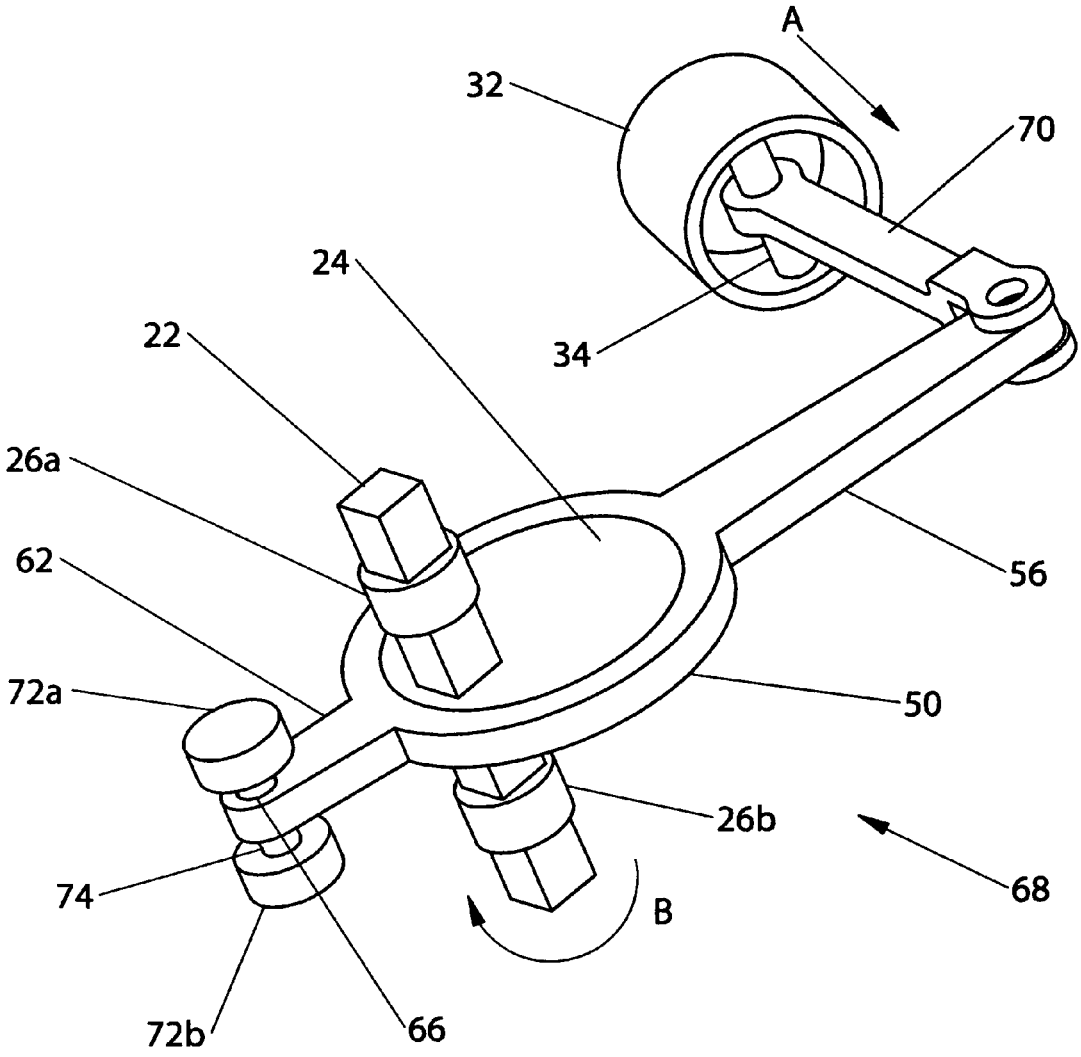
FIG. 6 is a schematic diagram of an exemplary embodiment of an apparatus for an inline engine of the present invention.

An example of a rocker arm/lever 50 of the present invention is shown in FIG. 5. As can be seen from FIGS. 5, 6 and 7, the straight connecting rod 30 of the prior art is replaced by a pair of the rocker arm/lever 50 for pivotally connecting to a circular eccentric 24 (FIG. 6) and a connecting rod 70 (FIG. 6). The big portion 52 of the rocker arm/lever 50 has an opening 54 in which the circular eccentric 24 (FIG. 6) is pivotally installed for realization of the aforementioned pivotal connection of the circular eccentric 24 to the rocker arm/lever 50. The rocker arm/lever 50 has one extended arm 56 with an opening 58 at the distal end 60 of it for pivotally connecting to one end of the connecting rod 70 (FIG. 6) with a pin (not shown) and another extended arm 62 with an opening 66 at the distal end 64 of it for pivotally mounting a pair of rollers 72*a* and 72*b* with a pin 74 (FIG. 6). Length of the first arm 56 is indicated by letter "D" as a distance between the opening 54 for the circular eccentric 24 (FIG. 6) of the big portion 52 of the rocker arm/lever 50 and the opening 58 of the extended arm 56. Distance D is defined by design requirements. Length of the second arm 62 is indicated by letter "F" as a distance between the opening 54 for the circular eccentric 24 of the big portion 52 of the rocker arm/lever 50 and the opening 66 of the extended arm 60. This parameter is defined by design requirements as well. In FIG. 6 the entire assembly of the reciprocating piston mechanism with extended piston offset of the present invention, which as a whole is designated by reference numeral 68, comprises the piston 32, a main driveshaft 22, the circular eccentric 24, the rocker arm/lever 50 and the connecting rod 70. The extended arm 62 of the rocker arm/lever 50 has the pair of roller 72*a* and 72*b* on the pin 74 pivotally mounted in the opening 66. This assembly serves to convert the reciprocating motion of the piston 32 as indicated by arrow A to the rotational motion of the driveshaft 22 as indicated by arrow B. A counterbalance, if needed can be mounted next to the circular eccentric 24 on the driveshaft 22.

Figure 7:
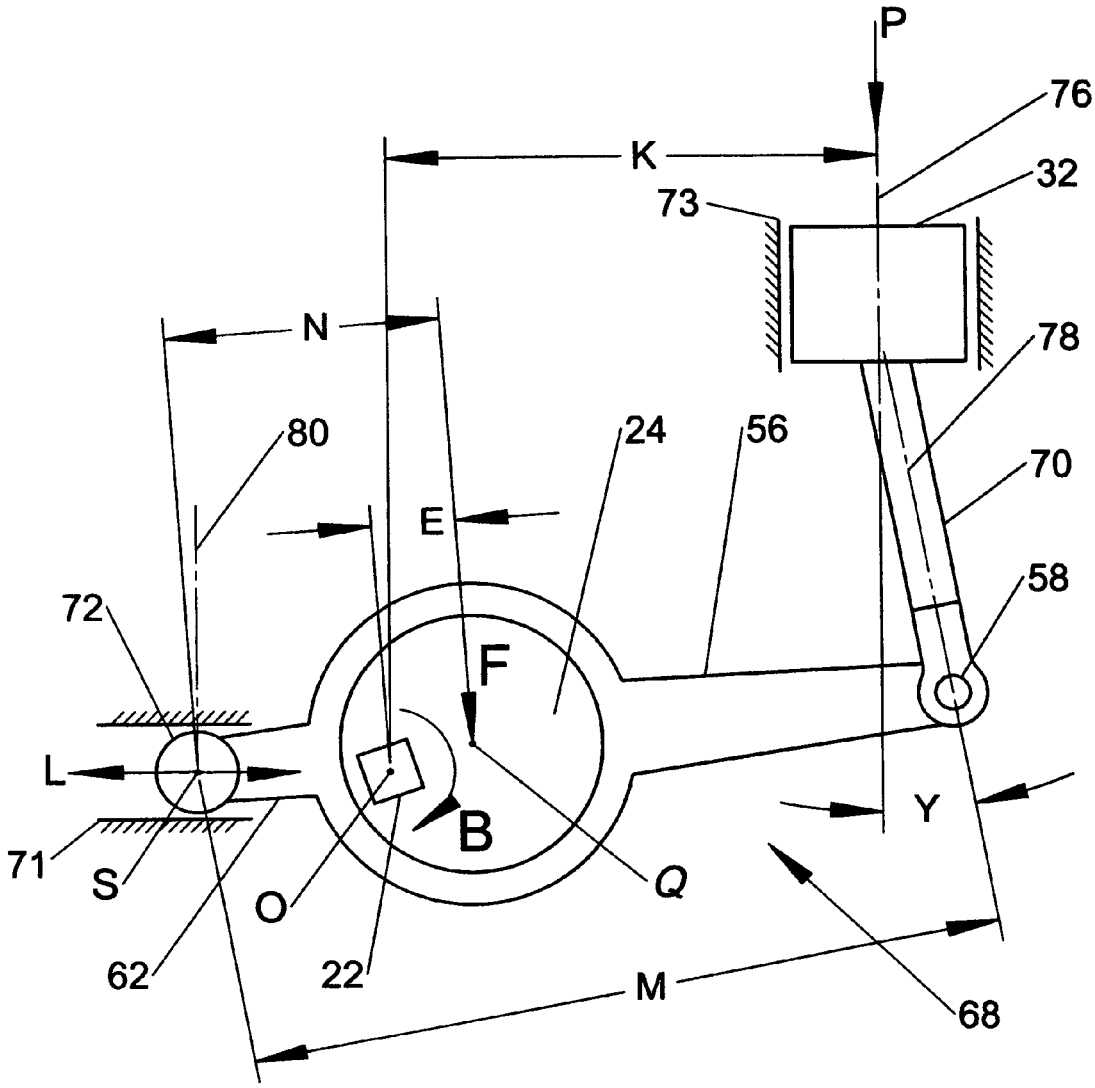
FIG. 7 is a schematic diagram of force of a rotational moment amplification of an exemplary embodiment of an apparatus for an inline engine of the present invention.

FIG. 7 is a schematic diagram of a force of a rotational moment amplification of an exemplary embodiment of an apparatus for an inline engine of the present invention. Letter "O" designates the axis of the driveshaft 22 as the center of rotation of the circular eccentric 24. Force P, moving the piston 32 down the cylinder 73 (shown schematically) is transmitted to the rocker arm/lever 50 in the direction from the wrist pin 34 (FIG. 6) disposed inside of the piston 32 to the opening 58 of the extended arm 56 of the rocker arm/lever 50 along the centerline 78 of the connecting rod 70. The rollers 72, of the arm 62 of the rocker arm/lever 50, can move only back and forth along substantially defined line L in a confined pathway/guide 71 (shown schematically). The direction of that line, as well as configuration of the confined pathway/guide is defined by overall design requirements of an engine as well. That controlled movement of the distal end 64 (FIG. 5) of the extended arm 62 of the rocker arm/lever 50 guarantees that the rocker arm/lever 50 does not spin during rotation of the driveshaft 22. The distal end 64 of the extended arm 62 of the rocker arm/lever 50, serves as the fulcrum of the rocker arm/lever 50 as well. In the present embodiment of the current invention, line L is a horizontal straight line. In this case, force F, which causes rotation of the eccentric 24, as indicated by arrow B, is acting along the line between a point of intersection of a vertical line 80 passing through the fulcrum of the rocker arm/lever 50 and the centerline 78 of the connecting rod 70, and the center of the circular eccentric 24, designated by letter "Q". Distance E, between force F and the center of rotation O, is the arm of the rotational moment. Distance between force F and the fulcrum is designated by letter "N". Distance between force acting along the centerline 78 of the connecting rod 70 and the fulcrum is designated by letter "M". Value of force F is determined by the rule of a lever. Rotational moment or torque applied to the driveshaft 22 is a product of force F and its arm E with respect to the center of rotation O.

In a typical arrangement of a conventional internal combustion engine, the end of the connecting rod which is journaled on the throw of a crankshaft travels in a circular path. The diameter of that circular path is equal to the distance the piston moves up and down in its cylinder or "piston displacement" and the distance this end of the connecting rod oscillates in the transverse direction. This particular distance defines an acute angular span between the cylinder axis and the centerline between the end of this connecting rod connected to a wrist pin disposed inside of the piston and the end of the rod journaled on the throw of the crankshaft. This angle directly affects friction loses when the piston travels inside the cylinder. Any increase of the throw of the crankshaft automatically increases the angle and, as a consequence, associated friction loses.

On the other hand, the distal end 60 of the rocker arm/lever 50 (FIG. 5) of the exemplary embodiment of the device of the present invention travels during a full rotational cycle on an elliptical path. Piston travel or displacement is defined by the major axis of that ellipse, whereas the minor axis of the ellipse defines how the end of the connecting rod connected to the opening 58 of the extended arm 56 of the rocker arm/lever 50 oscillates with respect to the cylinder axis 76 (FIG. 7). That angle between the cylinder axis 76 and the connecting rod axis 78 is designated by letter "Y" in FIG. 7. It is easily understood that in the embodiment of the device of the present invention friction loses inside the cylinder will be smaller.

Letter "K" in FIG. 7 designates offset of the cylinder with respect to the driveshaft 22. Changing the offset K, which is a design parameter, allows for variation of maximum values of another design parameter, i.e., the angle Y during downstroke and upstroke within the angular span of oscillation of the end of the connecting rod connected to the opening 58 of the extended arm 56 of the rocker arm/lever 50 in the cycle. It adds additional control of friction loses in a power stroke.

Figure 8:
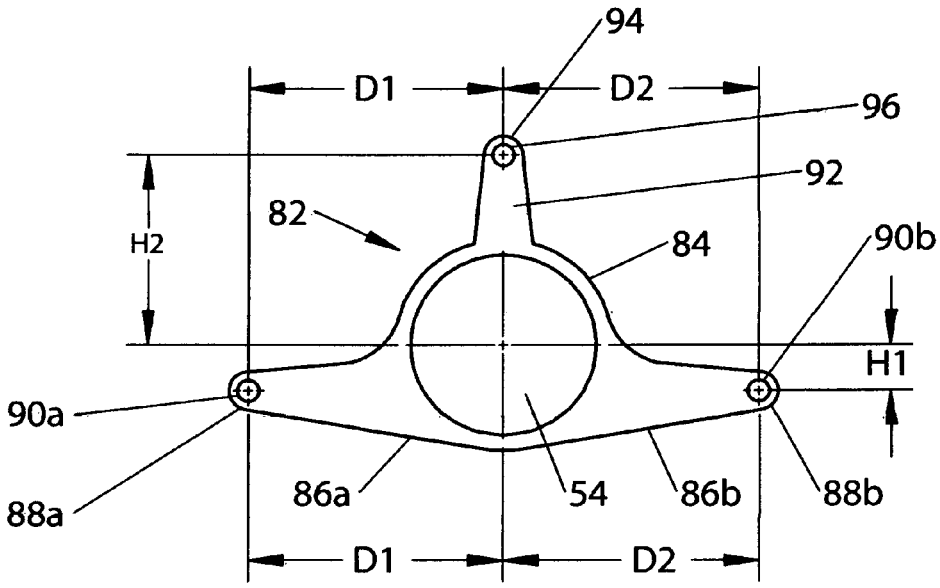
FIG. 8 is a schematic diagram of an exemplary embodiment of a rocker arm/lever for a U-engine of the present invention.
Figure 9:
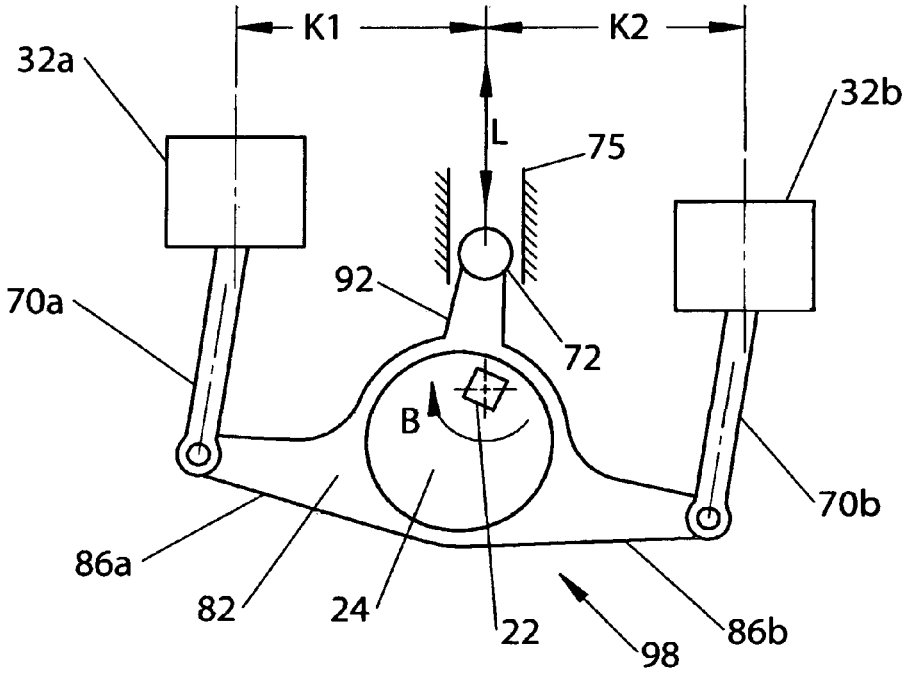
FIG. 9 is a schematic diagram of an exemplary embodiment of an apparatus for a U-engine of the present invention.

An example of a rocker arm/lever 82 of the present invention for a U-engine is shown in FIG. 8. As can be seen from FIG. 8, a big portion 84 has the same as the rocker arm/lever 50 in FIG. 5 opening 54 in which the same circular eccentric 24 (FIG. 9) is pivotally installed for realization of the pivotal connection of the circular eccentric 24 to the rocker arm/lever 82. The rocker arm/lever 82 has two extended arms 86*a* and 86*b* with opening 90*a* and 90*b* at corresponding distal ends 88*a* and 88*b* of it for pivotally connecting to one end of the corresponding connecting rods 70*a* and 70*b* (FIG. 9) with pins (not shown) and another extended arm 92 with an opening 96 at the distal end 94 of it for pivotally mounting a pair of rollers 72 (FIG. 9). Lengths of the arms 86*a* and 86*b* are indicated by D1 and D2 as distances between the opening 54 for the circular eccentric 24 (FIG. 9) of the big portion 84 of the rocker arm/lever 82 and the openings 90*a* and 90*b* of the extended arms 86*a* and 86*b*. Distances D1 and D2 are defined by design requirements and can differ. Length of the arm 92 is indicated by H2 as a distance between the opening 54 for the circular eccentric 24 of the big portion 52 of the rocker arm/lever 82 and the opening 94 of the extended arm 92. This parameter is defined by design requirements as well. The openings 90*a* and 90*b* are offset down from the opening 54 by distance H1 in order to reduce overall height of the mechanism. At the same time, overall envelope of the mechanism restricts value of H1.

An exemplary embodiment of the reciprocating piston mechanism with extended piston offset of the present invention utilizing rocker arm/lever 82 is shown generally in FIG. 9 and as a whole is designated by reference numeral 98. This particular embodiment of the current invention comprises the circular eccentric 24 integrally mounted on the driveshaft 22, a pair of connecting rods 70*a* and 70*b*, a pair of pistons 32*a* and 32*b* and pair of rollers 72. Extended arms 86*a* and 86*b* of the rocker arm/lever 82 are pivotally connected at their distal ends to one of the ends of the corresponding connecting rods 70*a* and 70*b*. The other ends of the corresponding rods 70*a* and 70*b* are pivotally connected to the wrist pins of the corresponding pistons 32*a* and 32*b* disposed inside of the pistons. The extended arm 92 of the rocker arm/lever 82 at its distal end 94 has the pair of rollers 72 on a pin (not shown) pivotally mounted in the opening 96. The rollers 72 of the arm 92 of the rocker arm/lever 82 can move up and down only along substantially defined vertical line L in a confined pathway/guide 75 (shown schematically). This assembly serves to convert the reciprocating up and down motion of the pistons 32*a* and 32*b* to the rotational motion of the driveshaft 22 as indicated by arrow B.

Figure 10:
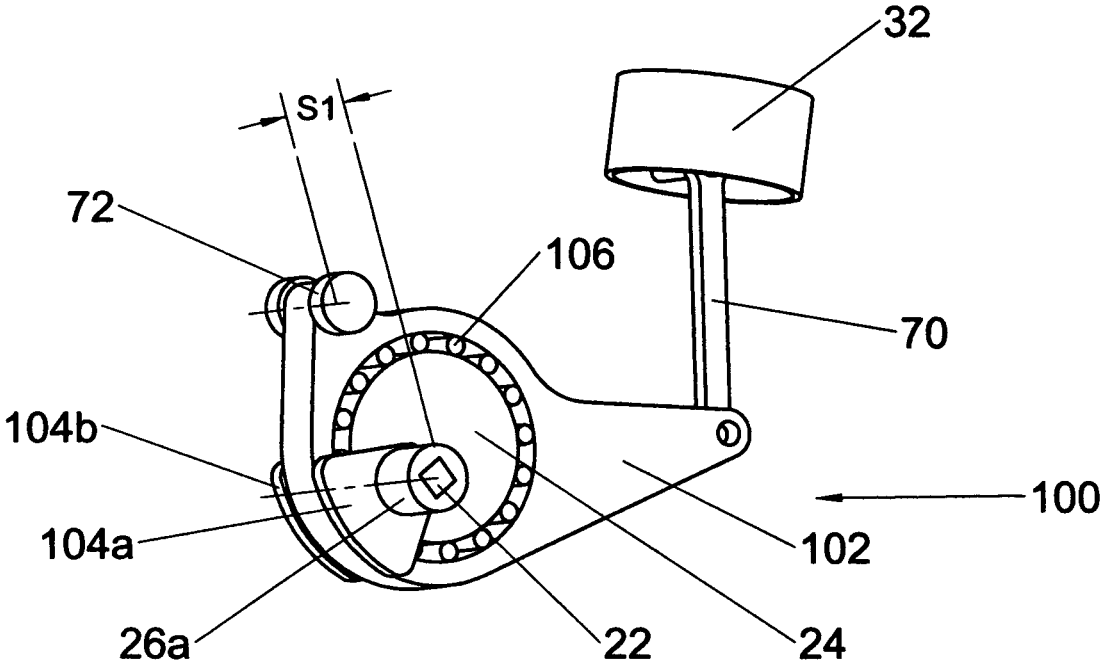
FIG. 10 is a schematic diagram of another exemplary embodiment of an apparatus for an inline engine of the present invention with a different position of rollers of a fulcrum.
Figure 11:
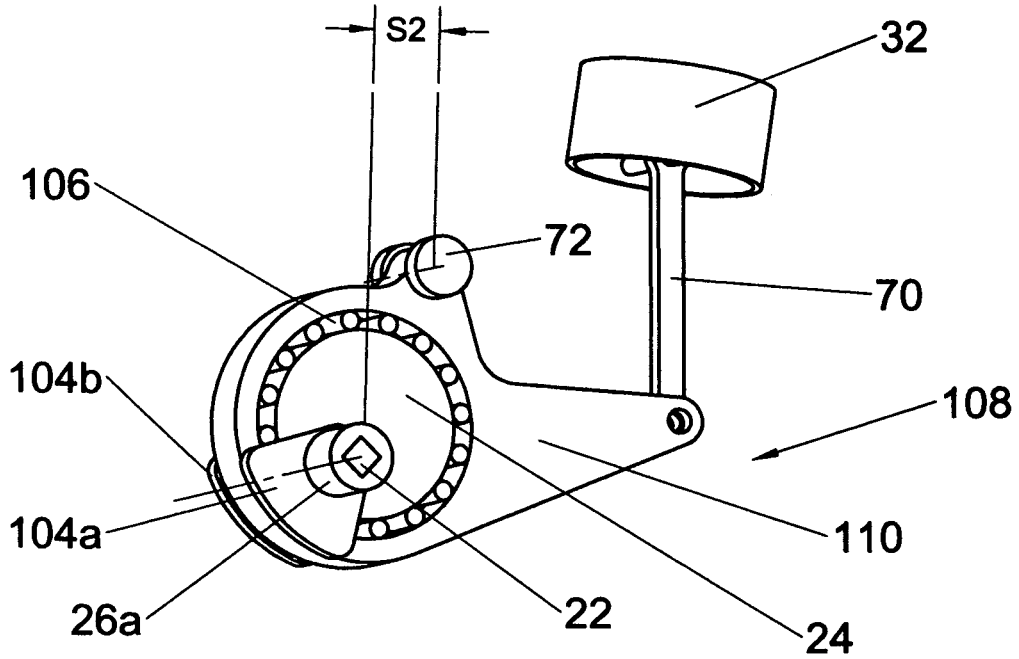
FIG. 11 is a schematic diagram of yet another exemplary embodiment of an apparatus for an inline engine of the present invention with still another position of rollers of a fulcrum.

In FIGS. 10 and 11 additional assemblies of the reciprocating piston mechanism with extended piston offset of the present invention, which as a whole are designated by reference numerals 100 and 108 are presenting examples of different rocker arms/levers of the present invention. In each assembly a needle/roller bearing 106 is mounted on the circular eccentric 24. Counterbalances 104*a* and 104*b* with openings for mounting of substantially the same cross-section as a cross-section of the shaft 22 are mounted on the driveshaft 22 next to the circular eccentric 24 on each side of it and kept in place by bushings 26*a* and 26*b* (26*b* not shown). The counterbalances 104*a* and 104*b* help to keep the bearing 106 in place as well. Rocker arms/levers 102 and 110 are mounted on the bearings 106 in each of the assemblies 100 and 108 respectively. The needle/roller bearing 106 helps to control friction loses in the reciprocating piston mechanism. A pair of rollers 72 of each assembly 100 and 108 serves as the fulcrum of the rocker arms/levers 102 and 110 respectively. Because value of rotational force F is determined by the rule of a lever, position of the fulcrum of the lever is very important. In a reciprocating piston mechanism with the center line of a cylinder passing through the center line of a crankshaft, the crankshaft rotates 180° in order for a piston to move from the Top Dead Center to the Bottom Dead Center. In contrast, in the reciprocating piston mechanism with extended piston offset of the present invention position of the fulcrum of a rocker arm/lever affects aspiration of the engine. Increasing dimension S2 of the assembly 108 of FIG. 11 increases the angle through which the driveshaft 22 of the reciprocating piston mechanism with extended piston offset moves when it rotates in a clockwise direction during the downstroke (power stroke and intake stroke) over 180°. Therefore the internal combustion engine has a longer time power stroke/intake cycle than exhaust cycle and that improves aspiration of the engine. When used in compressors, the intake stroke is extended which improves aspiration for a compressor. On the other hand, increasing dimension Si of the assembly 100 of FIG. 10 decreases the angle through which the driveshaft 22 of the reciprocating piston mechanism with extended piston offset moves when it is rotated in a clockwise direction during the downstroke. At the same time, the overall value of the piston displacement of the mechanism of the present invention depends to a greater degree on the lengths of the lever arms with respect to the fulcrum than to the value of the eccentricity of the eccentric.

Neither inlet and outlet valves nor corresponding camshafts and spark plugs are shown in FIGS. 7, 9, 10 and 11 because they are not affected in any way by the current invention.

A method of the invention for increasing the torque on the output shaft and/or for reducing the fuel consumption of the internal combustion engine comprises replacing a crankshaft of a conventional internal combustion engine with the device of the present invention that contains at least one cylinder having a longitudinal axis, at least one piston that has a pivot pin and is slidingly installed in the cylinder, a main driveshaft having a central axis, which is offset at a distance from the longitudinal axis of the cylinder, a circular eccentric which is eccentrically and non-rotationally secured on the main drive shaft, a rocker arm/lever pivotally mounted on the said circular eccentric and a connecting rod connecting the cylinder and one end of the rocker arm/lever. The other end of the rocker arm/lever can move back and forth only along a substantially defined line in a confined pathway/guide.

During the operation, the power piston 32 (FIG. 6) moves linearly in the directions of arrow A and converts by means of the rocker arm/lever 50 pivotally mounted on the circular eccentric 24 and the connecting rod 70 its reciprocating motion to rotational motion of the abovementioned circular eccentric 24 (as indicated by directional arrow B in FIG. 9) which results in rotation of the shaft 22. As shaft 22 rotates in the direction of arrow B, it turns the circular eccentric 24 which translates into linear reciprocating movements of other pistons in the cylinder of the engine.

Thus, it has been shown that the apparatus of the invention performs its functions substantially in the same way as a conventional crankshaft type but with a greater possibility of adjusting design parameters of the mechanism. In other words, the apparatus of the invention provides an alternative to a conventional crankshaft for an internal combustion engine that is simple in design, less expensive, and easier to manufacture and balance. By replacing a crankshaft with an eccentric-rocker arm/lever pair this apparatus provides additional tools such as an eccentricity of a circular eccentric, arms of a rocker arm/lever and piston offset to build a better engine. By amplifying a force, produced during fuel combustion, this apparatus will deliver torque for the required power of an internal combustion engine using less fuel. On the other hand, at the same fuel consumption this apparatus will increase torque and power of the engine if and when needed. This particular apparatus of the current invention will allow building an internal combustion engine with two parallel banks of cylinders, i.e., a U-engine which is simpler in design, less expensive and easier to manufacture than a V-engine. The apparatus will allow unrestricted number of cylinders for a four-stroke or two-stroke internal combustion engine. The apparatus allows replacement of journal bearings of a crankshaft by roller and/or needle bearings and, as a result, reducing heat generation in an engine and thus extending engine life span.

While preferred embodiments have been shown and described, various modifications and substitutions may be made thereto without departing from the spirit and scope of the invention. In fact, even though only two positions of a fulcrum are indicated on the drawings the fulcrum can be positioned anywhere outside of an opening for a circular eccentric and directions of its restricted movement can vary as well. For example, though this embodiment describes a shaft as having a polygon or elliptical cross-section for indexing the circular eccentrics, one skilled in the art would recognize that there might be other means to index the circular eccentrics on the shaft as well. One skilled in the art would also recognize that more than a pair of bushings, which shown and described, can be employed on the shaft for additional bearing supports and/or positioning of the circular eccentrics. As well, even though a driveshaft with a circular eccentric is used to describe the present invention with a second order lever, a similar second order lever can be used with the crankshaft of a conventional internal combustion engine. Further more a first order lever can replace the second order lever to offset the piston. Even though this embodiment describes the apparatus as applied for an internal combustion engine, one skilled in the art would recognize that compressors and pumps are within the scope of this invention also. Accordingly, it is to be understood that the present invention has been described by way of illustration and not limitation.

What I claim is:

1. A reciprocating piston mechanism with extended piston offset, comprising:

a main drive shaft having a central axis;

a circular cylindrical body rigidly and eccentrically mounted on said drive shaft by means of an indexing opening;

a lever having means for pivotally mounting thereof on said circular cylindrical body, the lever having at least a first arm and a second arm;

at least one cylinder, that has a longitudinal axis, which is offset at a distance from the main drive shaft central axis;

a piston slidingly installed in said at least one cylinder, the piston having a pivot pin;

a connecting rod having one end pivotally connected to said second arm of the lever and another end, pivotally connected to said piston;

at least one roller rotationally installed on said first arm of the lever; and a guide for guiding the roller along a predetermined stationary pathway where said roller functions as a fulcrum of the lever.

2. The reciprocating piston mechanism according to claim 1, further comprising: a third arm that extends substantially outward from the means for pivotally mounting the lever on said circular cylindrical body in the direction opposite to the second arm; a second cylinder that has a longitudinal axis; a second piston slidingly installed in said second cylinder, the piston having a pivot pin; and second connecting rod having one end pivotally connected to said third arm another end pivotally connected to said second piston.

3. The reciprocating piston mechanism according to claim 1, wherein the lever is pivotally mounted on said circular cylindrical body on a rolling bearing.

4. The reciprocating piston mechanism according to claim 2, wherein the lever is pivotally mounted on said circular cylindrical body on a rolling bearing.

5. The reciprocating piston mechanism according to claim 1, wherein the circular cylindrical body is circular eccentric and wherein said means for pivotally mounting the lever on said circular cylindrical body is a circular opening.

6. The reciprocating piston mechanism according to claim 2, wherein the circular cylindrical body is circular eccentric and wherein said means for pivotally mounting the lever on said circular cylindrical body is a circular opening.

7. The reciprocating piston mechanism according to claim 3, wherein the circular cylindrical body is circular eccentric and wherein said means for pivotally mounting the lever on said circular cylindrical body is a circular opening.

8. The reciprocating piston mechanism according to claim 4, wherein the circular cylindrical body is circular eccentric and wherein said means for pivotally mounting the lever on said circular cylindrical body is a circular opening.

9. The drive shaft and piston assembly of claim 1, wherein the indexing opening of said circular cylindrical body has a cross-section, which is substantially the same as a cross-section of the drive shaft, that exclude rotation of the circular eccentric relative to the drive shaft.

* * * * *